US010109229B2

(12) United States Patent
Wang et al.

(10) Patent No.: US 10,109,229 B2
(45) Date of Patent: Oct. 23, 2018

(54) DISPLAY PANEL DRIVING CIRCUIT AND COMPENSATION METHOD THEREOF

(71) Applicant: Raydium Semiconductor Corporation, Hsinchu (TW)

(72) Inventors: Shun-Yuan Wang, Taoyuan (TW); Chih-Hsien Jen, Hsinchu (TW); Chih-Chuan Huang, Zhubei (TW); Wen-Tsung Lin, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 7 days.

(21) Appl. No.: 15/353,819

(22) Filed: Nov. 17, 2016

(65) Prior Publication Data

US 2017/0140696 A1 May 18, 2017

(30) Foreign Application Priority Data

Nov. 17, 2015 (TW) ..... 104137929 A

(51) Int. Cl.
*G09G 3/20* (2006.01)

(52) U.S. Cl.
CPC ... *G09G 3/2092* (2013.01); *G09G 2310/0248* (2013.01); *G09G 2310/06* (2013.01)

(58) Field of Classification Search
CPC ..... G09G 3/2092; G09G 2310/06; G09G 2310/0248
See application file for complete search history.

(56) References Cited

U.S. PATENT DOCUMENTS 6,307,681 B1 * 10/2001 Aoki ..... G09G 3/3648 340/14.1
2004/0189571 A1 * 9/2004 Yo ..... G09G 3/3607 345/92
2008/0212669 A1 * 9/2008 Yamazaki ..... H03K 3/64 375/238
2012/0056916 A1 * 3/2012 Ryu ..... G09G 3/3208 345/691
2015/0061985 A1 * 3/2015 Sugiyama ..... G09G 3/3677 345/87
2016/0027378 A1 * 1/2016 Kim ..... G02B 6/0055 345/207
2016/0180785 A1 * 6/2016 Jin ..... G09G 3/3614 345/87
2017/0330521 A1 * 11/2017 Zhao ..... G09G 3/3611

* cited by examiner

*Primary Examiner* — Premal R Patel

(57) ABSTRACT

The present invention provides a display panel driving circuit and compensation method thereof. The display panel driving circuit comprises a near end load, a far end load, an operating circuit and a pre-charging control circuit. The operating circuit is configured to receive display data. The pre-charging control circuit is coupled to the near end load and the far end load respectively. The pre-charging control circuit outputs a first signal and a second signal to the near end load and the far end load respectively according to the display data that a first waveform from the near end load is the same as a second waveform from the far end load.

10 Claims, 8 Drawing Sheets

DISPLAY PANEL DRIVING CIRCUIT AND COMPENSATION METHOD THEREOF

BACKGROUND OF THE INVENTION

1. Field of the Invention

The present invention relates to a display panel driving circuit and compensation method thereof, especially a display panel driving circuit and compensation method thereof which can improve the waveform outputted from a far-end load.

2. Description of the Prior Art

Conventional structure of liquid crystal display panel driving device, as shown in FIG. 1A, comprises a liquid crystal panel (not shown), gate driver configured to activate gate lines of the liquid crystal panel, and source driver configured to charge/discharge cells of source lines of the liquid crystal panel to display image.

However, due to the distances between each source driver and the cell (RC1~RC5) are different, so that the equivalent resistance between the source driver output end and the cell of the near-end, and the equivalent resistance between the source driver output end and the cell of the far-end are different. As shown in FIG. 1B, the charge/discharge waveforms W1~W5 from source driving IC to near-end cell and to far-end cell are not completely the same, so that the image reacted by the cells occurred color difference.

SUMMARY OF THE INVENTION

In view of the above reason, one aspect of this invention provides a display panel driving circuit that is capable of determining whether the signal should be sent to near ends or far ends according to display data. The driving circuit will send higher and wider charge signals to the far ends to accelerate charging process of cells, so that the outputted waveforms at the far end and the near end have the same height and width. The result of image difference caused by the waveform attenuation at the far end will be therefore cured.

One aspect of this invention is to provide a display panel driving circuit and compensation method thereof. The display panel driving circuit comprises a near end load, a far end load, an operating circuit and a pre-charging control circuit. The operating circuit is configured to receive display data. The pre-charging control circuit is coupled to the near end load and the far end load respectively. The pre-charging control circuit outputs a first signal and a second signal to the near end load and the far end load respectively according to the display data that a first waveform from the near end load is the same as a second waveform from the far end load.

Another embodiment is to provide a method for compensating a display panel driving circuit, comprising following steps: (S1) an operating circuit receives a display data; (S2) a pre-charging control circuit outputs a first signal to a near-end load according to the display data; (S3) the pre-charging control circuit outputs a second signal to a far-end load according to the display data, wherein a voltage of the second signal is larger than a voltage of the first signal; and (S4) the near-end load and the far-end load output a first waveform and a second waveform respectively, and the first waveform and a second waveform are the same.

Compared to the prior art, the driving circuit of the present that is capable of determining whether the signal should be sent to near ends or far ends according to display data, further adjust the pulse width and pulse height of the signal, so that the outputted voltage charges much higher to the far end. Accordingly, the outputted waveform at far end can be compensated by adjusting the width and the height of the voltage. The waveforms at near end and far end will be the same. The result of image difference caused by the waveform attenuation at the far end will be therefore cured.

DETAILED DESCRIPTION OF THE PREFERRED EMBODIMENT

Figure 1A:
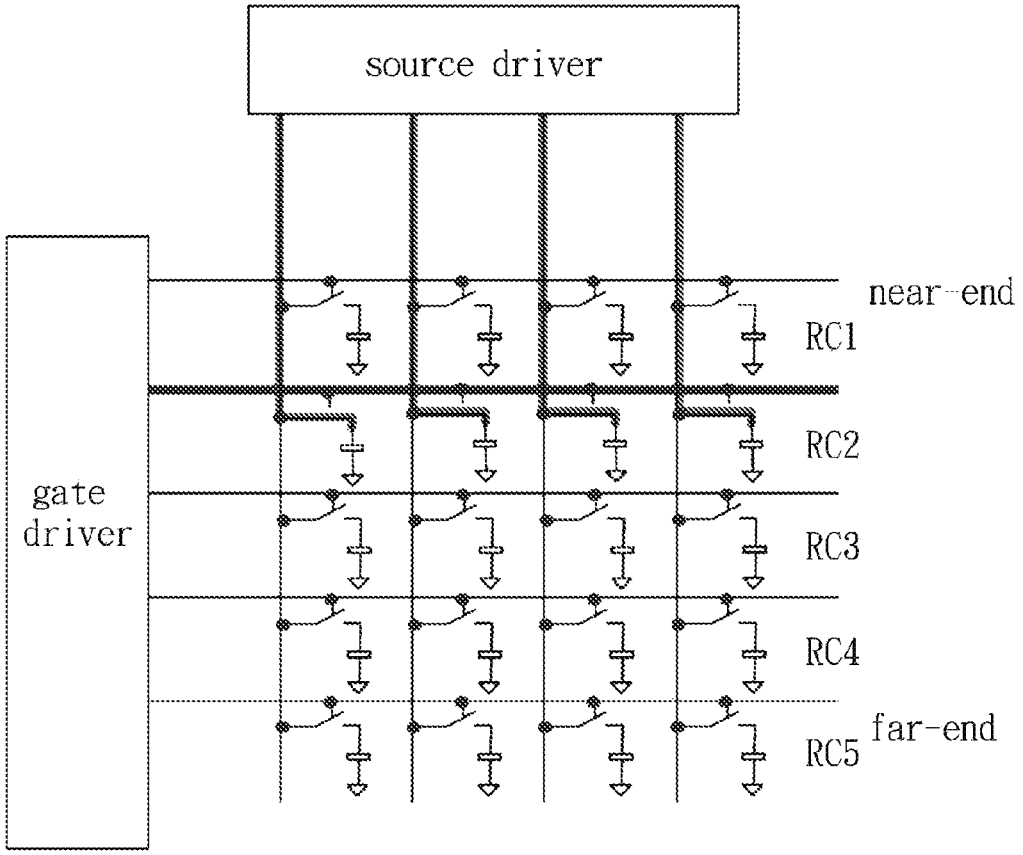
FIG. 1A (PRIOR ART)
FIG. 1A and FIG. 1B are schematic diagrams of traditional display panel driving circuit.
Figure 1B:
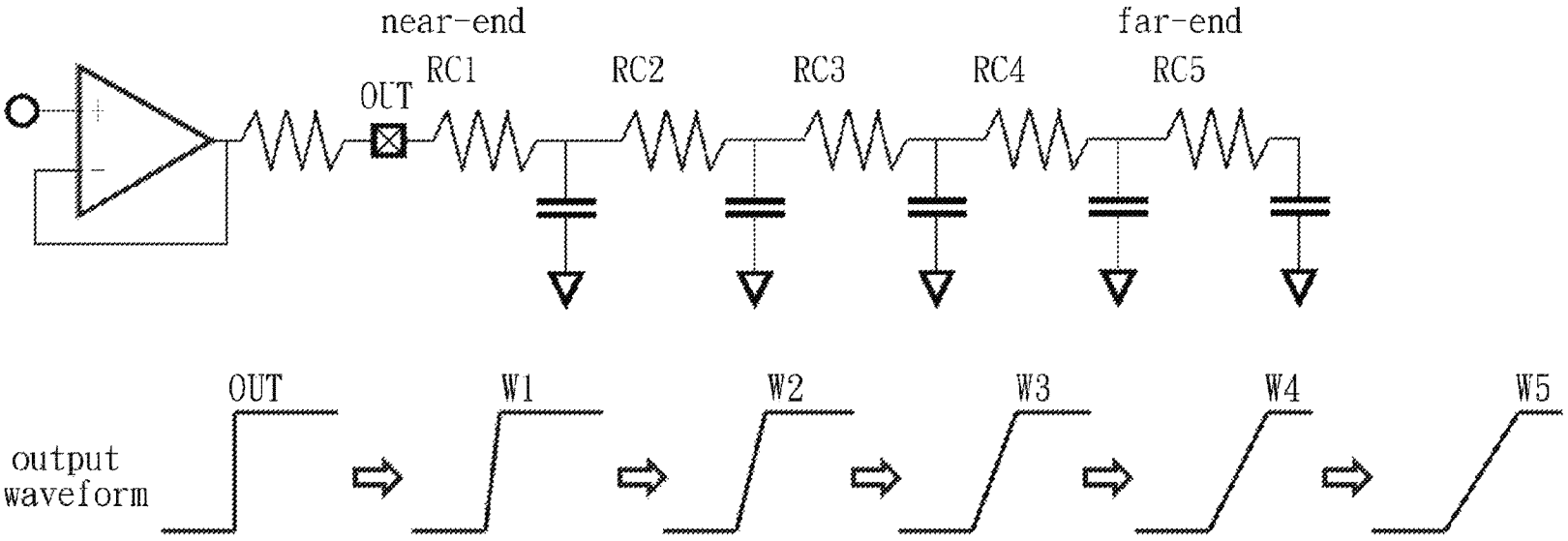
FIG. 1B (PRIOR ART)
Figure 2A:
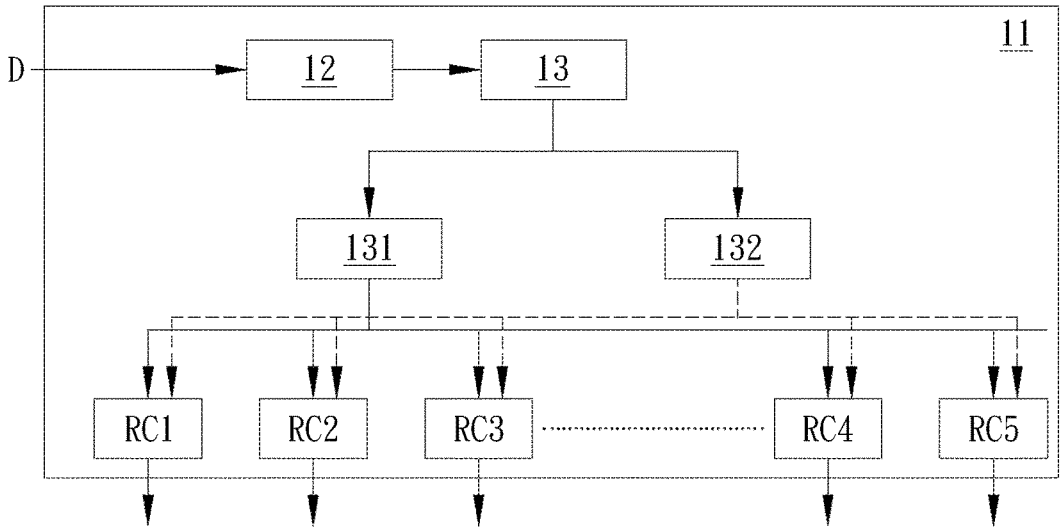
FIG. 2A is a block diagram of a display panel driving circuit in this application.

Please refer to FIG. 2A, FIG. 2A is a block diagram of a display panel driving circuit in this application. Display panel driving circuit 11 (e.g. a source driver) preferably comprises an operating circuit 12, a pre-charging control circuit 13, a first load RC1, a second load RC2, . . . , and a fifth load RC5. In this embodiment, the first load RC1 is referred to as a near-end load while the second load RC2 is referred to as a far-end load. The distance between the load RC3~RC5 and the display panel driving circuit 11 are sequentially increased.

The operating circuit 12 is coupled to the pre-charging control circuit 13, configured to receive a display data D. Wherein the operating circuit 12 preferably is a counter circuit, but not limited thereto. The operating circuit 12 is capable of determining whether the signal should be sent to near ends or far ends according to display data D. After calculating, the operating circuit 12 generates a signal to the pre-charging control circuit 13. The pre-charging control circuit 13 outputs signals to the near-end load and the far-end load (i.e. RC1~RC5) respectively, according to the display data D and the calculating result.

In detail, the display panel driving circuit 11 further comprises a width control circuit 131 and a height control circuit 132. The width control circuit 131 is coupled to the pre-charging control circuit 13, the near-end load and the far-end load (i.e. RC1~RC5). The width control circuit 131 can adjust and control the pulse widths of the signals according to the quantity of the display data D. Then the modified pulse widths of the signals are sent to the load ends (i.e. RC1~RC5).

The height control circuit 132 is also coupled to the pre-charging control circuit 13, the near-end load and the far-end load (i.e. RC1~RC5). The height control circuit 132 is capable of adjusting the pulse height of the signals which are sent to the load ends according to the distance between the near-end load and the operating circuit 12 and the distances between the far-end load and the operating circuit 12.

Figure 2B:
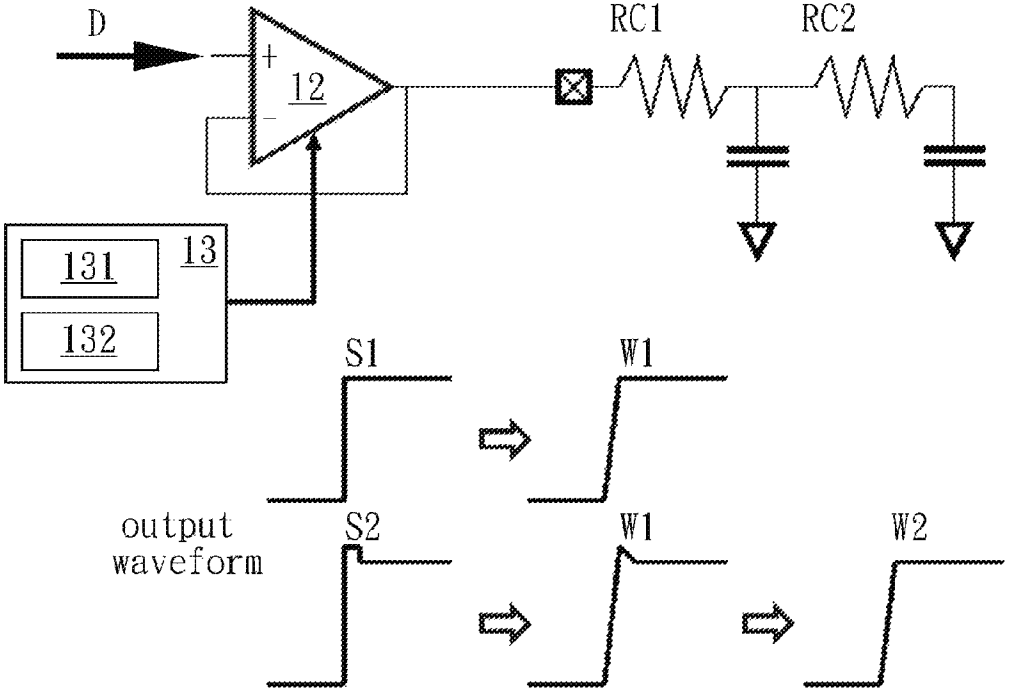
FIG. 2B-FIG. 2E are other schematic diagrams of display panel driving circuits in this application.

In one embodiment, please refer to FIG. 2B. When the operating circuit 12 receives the display data D, it is capable of determining whether the signal should be sent to near ends or far ends according to display data. While the distance between the load and the operating circuit 12 is longer, the pulse height of the outputted signal is higher. The more quantity of the display data D is received, the wider pulse width of the signal is outputted.

Still referring to FIG. 2B, the pre-charging control circuit 13 is coupled to the near-end load (i.e. the first load RC1), the far-end load (i.e. the second load RC2) and the operating circuit 12, respectively. The pre-charging control circuit 13 outputs a first signal S1 and a second signal S2 to the near-end load (i.e. the first load RC1) and the far-end load (i.e. the second load RC2) respectively according to the display data D and the calculating result by the operating circuit 12. As shown in FIG. 2B, the first load RC1 outputs a first waveform W1 after the first signal S1 passes. However, since the path over the second signal S2 transmitted to the second load RC2 includes a resistor of the first load RC1, the outputted waveform will attenuate if the second signal S2 equals to the first signal S1. In order to overcome this situation, the height control circuit 132 of the pre-charging control circuit 13 enhances the pulse height of the second signal S2; i.e., the voltage of the second signal S2 is larger than the voltage of the first signal S1. Accordingly, the first waveform W1 from the near-end load (i.e. the first load RC1) and the second waveform W2 from the far-end load (i.e. the second load RC2) are the same.

Another embodiment in this application is described below; taking three loads for an example, please refer to FIG. 2C. When the operating circuit 12 receives the display data D, it determines that the signals should be sent to the near end or the far end based on the quantity of the data. The pre-charging control circuit 13 is coupled to the first load RC1, the second load RC2, the third load RC3 and the operating circuit 12 respectively. The pre-charging control circuit 13 outputs a first signal S1, a second signal S2, and a third signal S3 to the first load RC1, the second load RC2, and the third load RC3 respectively according to the display data D and the calculating result by the operating circuit 12.

Figure 2C:
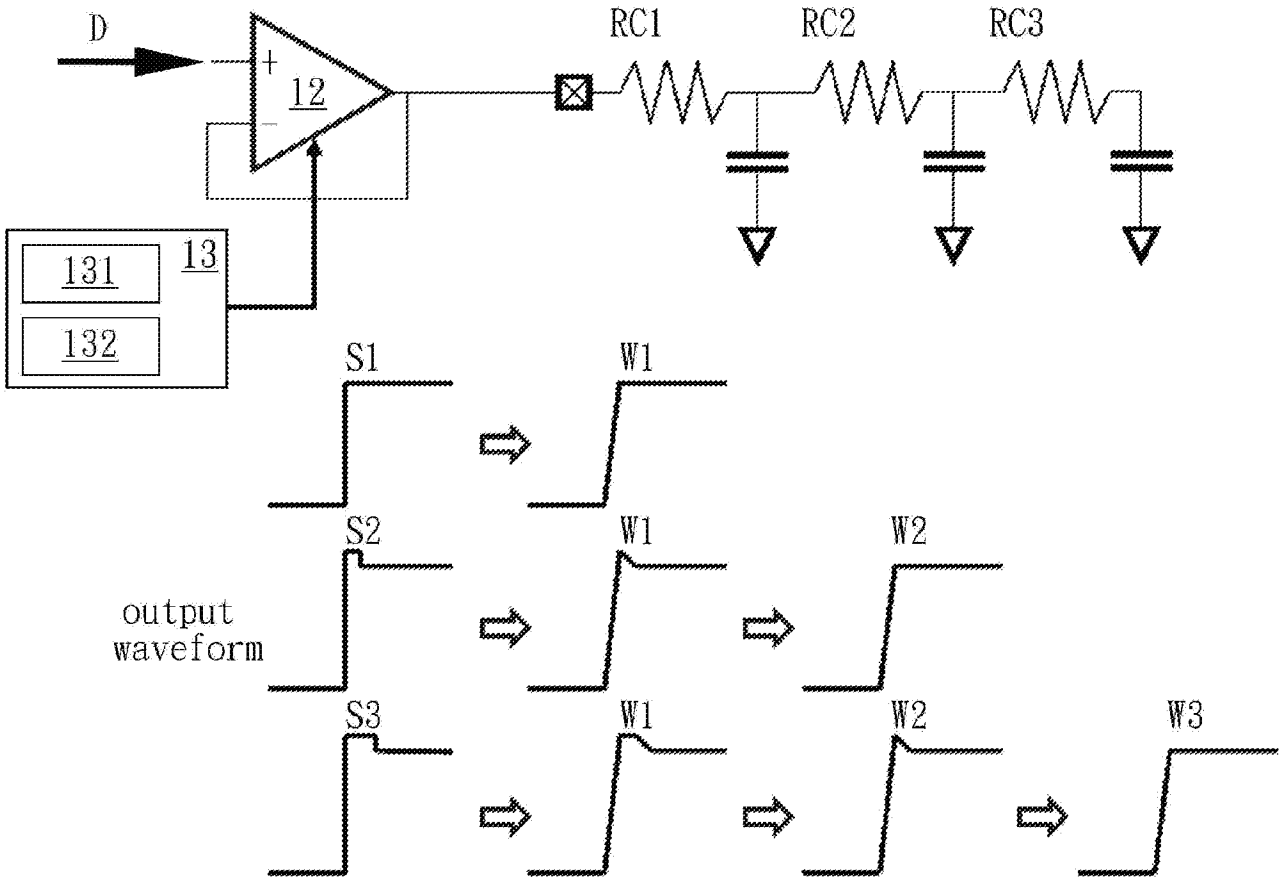

As shown in FIG. 2C, the first load RC1 outputs the first waveform W1 while the first signal S1 passes through. Similarly, the path over the second signal S2 transmitted to the second load RC2 includes a resistor of the first load RC1, and the path over the third signal S3 transmitted to the third load RC3 includes resistors of the first load RC1 and the second load RC2. Therefore, the pulse height of the second signal S2 must be larger than the pulse height of the first signal S1, and the pulse height of the third signal S3 must be larger than the pulse height of the second signal S2. The height control circuit 132 adjusts the pulse height relatively. That is, the voltage of the second signal S2 is larger than the voltage of the first signal S1, and the voltage of the third signal S3 is larger than the voltage of the second signal S2. Accordingly, it can overcome the attenuation during the signal transmitted to the far-end load.

Consequently, the outputted second waveform W2 that the second signal S2 passes through the resistor of the RC1 and the RC2 is the same as the first waveform W1. The outputted second waveform W3 that the third signal S3 passes through the resistors of the RC1 and RC2, and RC3 is also the same as the first waveform W1. The outputted waveforms are shown in FIG. 2C, the first waveform W1, the second waveform W2 and the third waveform W3 are the same.

Figure 2D:
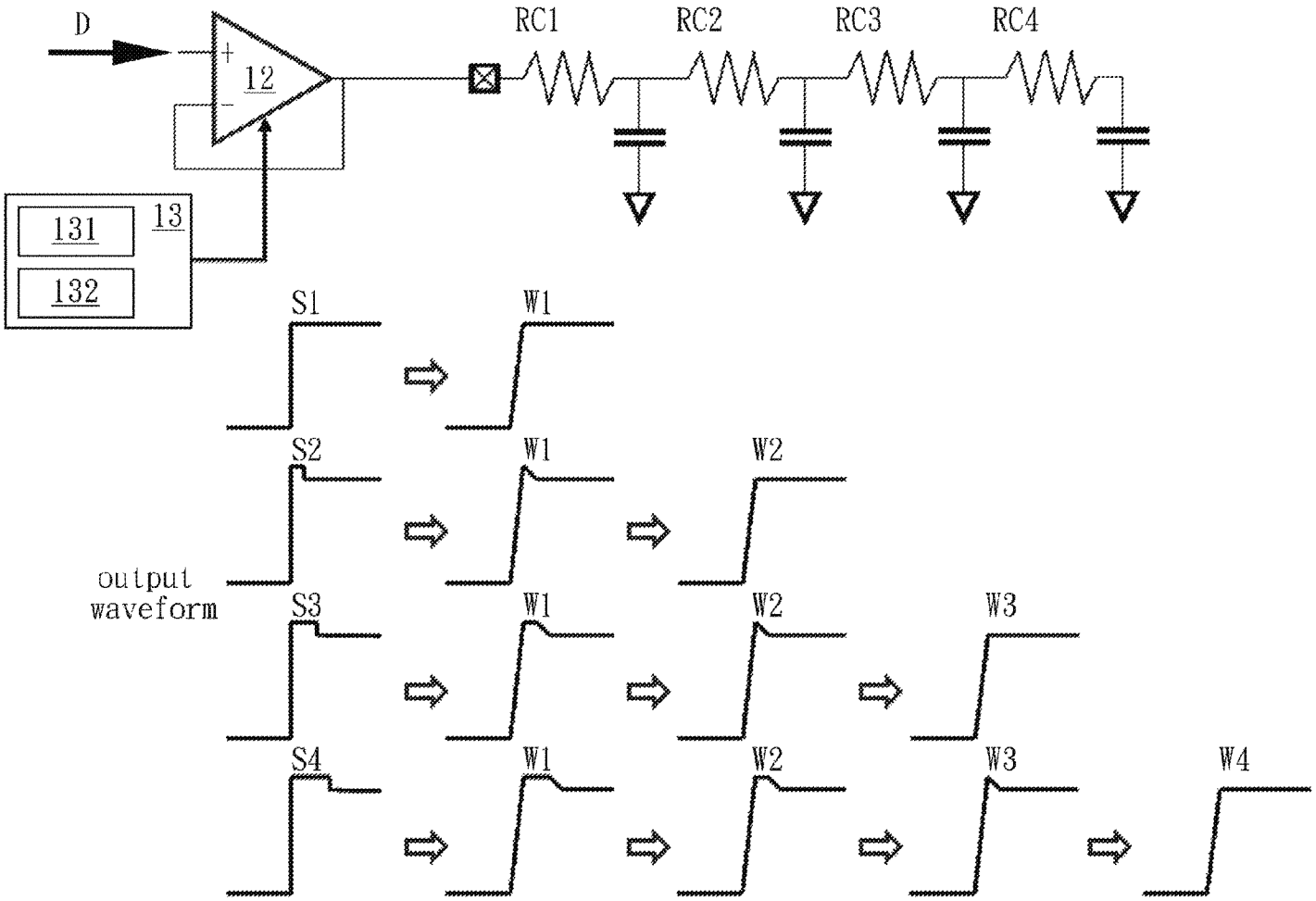
Figure 2E:
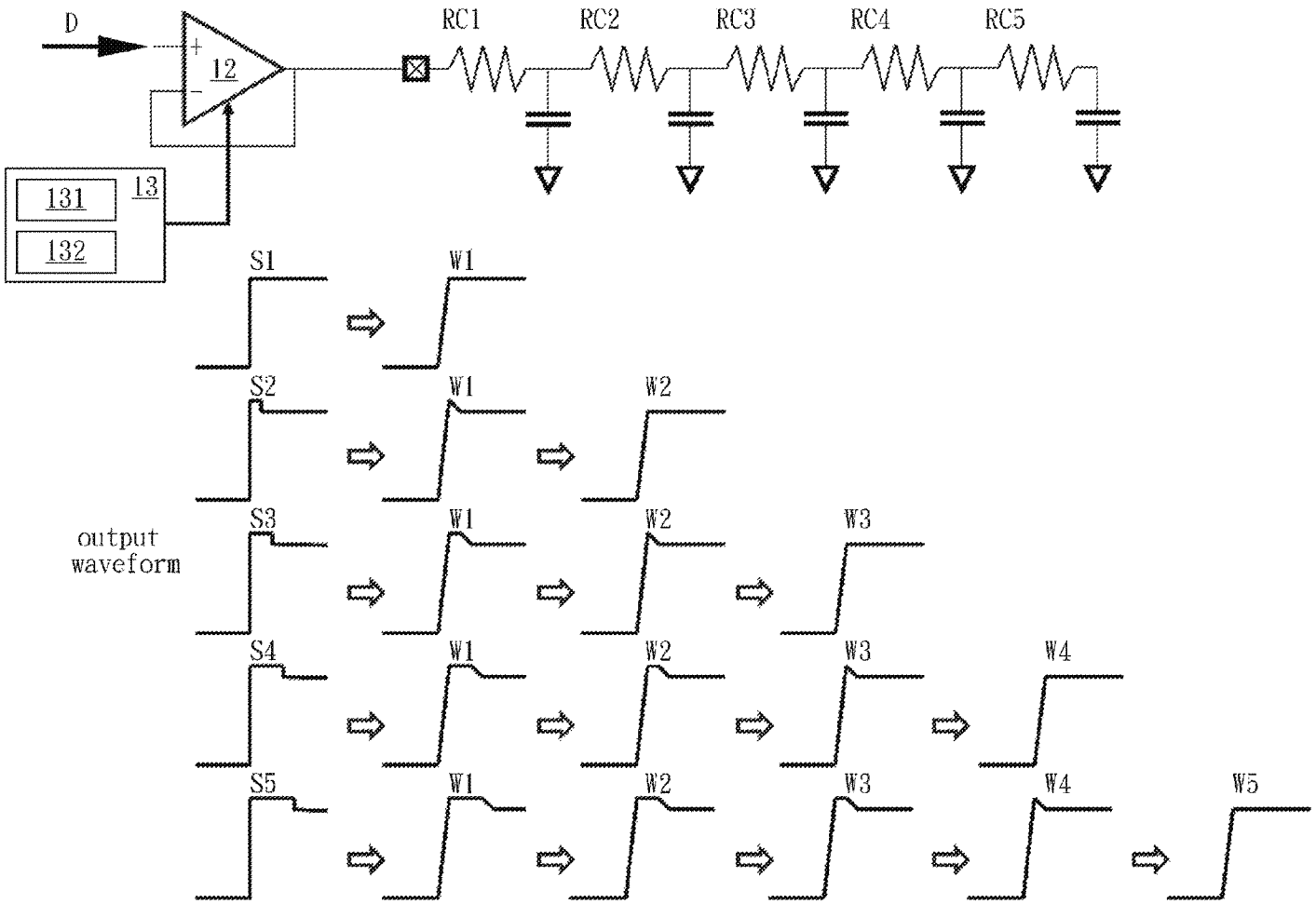
Figure 3:
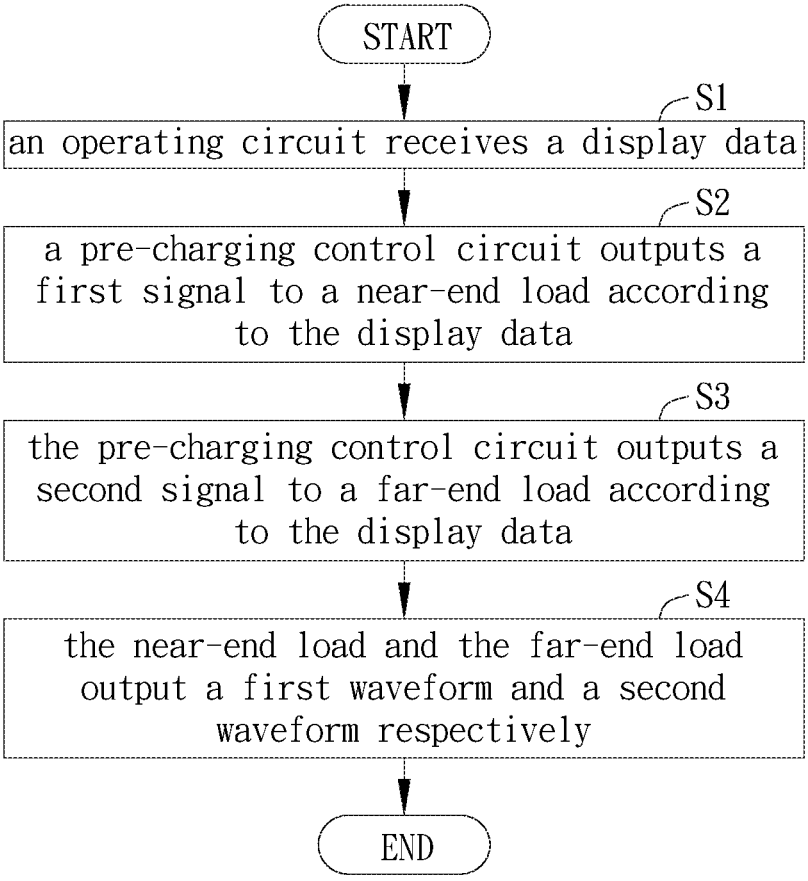
FIG. 3 is a compensating method flowchart of a display panel driving circuit in this application.

Other embodiments are shown in FIG. 2D and FIG. 2E. The circuit structures are similar to the above embodiment, only the quantities of the load are different. FIG. 2D takes four loads as an example, and FIG. 2E takes five loads as an example. Similarly, in FIG. 2D, the waveforms W1~W4 are the same; in FIG. 2E, the waveforms W1~W5 are also the same. In other embodiment, it is possible to use N number loads in the display panel driving circuit.

Another embodiment is to provide a method for compensating a display panel driving circuit, comprising following steps: (S1) an operating circuit receives a display data; (S2) a pre-charging control circuit outputs a first signal to a near-end load according to the display data; (S3) the pre-charging control circuit outputs a second signal to a far-end load according to the display data, wherein a voltage of the second signal is larger than a voltage of the first signal; and (S4) the near-end load and the far-end load output a first waveform and a second waveform respectively, and the first waveform and a second waveform are the same.

Wherein the method further comprising step (S3-1) controlling pulse width of the first signal and the second signal; and controlling pulse height of the first signal and the second signal. That is, to adjust and control the pulse widths and heights of the first signal S1 and the second signal S2, by using the width control circuit 131 and the height control circuit 132 respectively.

It is noted that the main circuit structure, the signal controlling and the transmission path are the same as the above embodiment, therefore, the details are neglected in this paragraph.

Compared to the prior art, the driving circuit of the present invention is capable of determining whether the signal should be sent to near ends or far ends according to display data, further adjust the pulse width and pulse height of the signal, so that the outputted voltage charges much higher to the far end. Accordingly, the outputted waveform at far end can be compensated by adjusting the width and the height of the voltage. The waveforms at near end and far end will be the same. The result of image difference caused by the waveform attenuation at the far end will be therefore cured.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A display panel driving circuit, comprising:

a near-end load;

a far-end load;

an operating circuit, configured to receive a display data; and a pre-charging control circuit, coupled to the near-end load and the far-end load respectively, the pre-charging control circuit outputs a first signal and a second signal to the near-end load and the far-end load respectively according to the display data so that a first waveform from the near-end load is the same as a second waveform from the far-end load, wherein a pulse width and a pulse height of the second signal are larger than a pulse width and a pulse height of the first signal.

2. The display panel driving circuit as claimed in claim 1, further comprising:

a width control circuit, coupled to the pre-charging control circuit, the near-end load and the far-end load, configured to control the pulse width of the first signal and the pulse width of the second signal respectively; and a height control circuit, coupled to the pre-charging control circuit, the near-end load and the far-end load, configured to control the pulse height of the first signal and the pulse height of the second signal respectively.

3. The display panel driving circuit as claimed in claim 2, wherein the pulse height of the first signal is adjusted according to a distance between the near-end load and the operating circuit, and a distance between the far-end load and the operating circuit.

4. The display panel driving circuit as claimed in claim 2, wherein the pulse width of the first signal is adjusted according to data quantity of the display data.

5. The display panel driving circuit as claimed in claim 1, wherein the operating circuit is a counter circuit.

6. A method for compensating a display panel driving circuit, comprising following steps:

(S1) an operating circuit receives a display data;

(S2) a pre-charging control circuit outputs a first signal to a near-end load according to the display data;

(S3) the pre-charging control circuit outputs a second signal to a far-end load according to the display data, wherein a pulse width and a pulse height of the second signal are larger than a pulse width and a pulse height of the first signal; and (S4) the near-end load and the far-end load output a first waveform and a second waveform respectively, and the first waveform and a second waveform are the same.

7. The method as claimed in claim 6, further comprising:

(S3-1) controlling the pulse width of the first signal and the pulse width of the second signal; and controlling the pulse height of the first signal and the pulse height of the second signal.

8. The method as claimed in claim 7, wherein the pulse height of the first signal is adjusted according to a distance between the near-end load and the operating circuit, and a distance between the far-end load and the operating circuit.

9. The method as claimed in claim 7, wherein the pulse width of the first signal is adjusted according to data quantity of the display data.

10. The method as claimed in claim 6, wherein the operating circuit is a counter circuit.

* * * * *